United States Patent [19]

Bolling

[11] Patent Number: 4,997,102

[45] Date of Patent: Mar. 5, 1991

[54] LID FOR A TRASH CONTAINER

[76] Inventor: Ambrose G. Bolling, 2808 Weir Ave., Weirton, W. Va. 26062

[21] Appl. No.: 442,898

[22] Filed: Nov. 29, 1989

[51] Int. Cl.[5] ..... B65D 45/16

[52] U.S. Cl. ..... 220/325; 220/327; 220/909

[58] Field of Search ..... 220/287, 315, 320, 327, 220/328

[56] References Cited

U.S. PATENT DOCUMENTS

| | | | |
|---|---|---|---|
| 922,275 | 5/1909 | Gleason et al. | 220/327 X |
| 1,160,061 | 11/1915 | Friberg | 220/287 X |
| 4,295,508 | 10/1981 | Metzger | 220/320 |
| 4,558,799 | 12/1985 | Hammond | 220/343 |
| 4,732,294 | 3/1988 | Bohler et al. | 220/320 |
| 4,832,227 | 5/1989 | Hoffman | 220/327 |

*Primary Examiner*—Stephen Marcus
*Assistant Examiner*—Nova Stucker
*Attorney, Agent, or Firm*—Donald J. Breh

[57] ABSTRACT

A lid for a trash container is disclosed including two lid members each having peripheral edge portions conforming to the size and shape of a rim of a standard trash container. The peripheral edge portions include a depending flange adapted to engage opposite outside surface portions of the trash container at the rim when the two members are drawn together. Each member is provided with at least one hole opening into the trash container sized to receive a predetermined shaped and sized article. According to a preferred embodiment, one lid member includes at least one circular hole having a diameter to receive a cylindrical container having a diameter not greater than the diameter of a predetermined size of standard beverage container and the other lid member includes at least one hole having a diameter to receive a cylindrical container having a diameter not greater than the diameter of a different predetermined size of standard beverage container.

11 Claims, 1 Drawing Sheet

LID FOR A TRASH CONTAINER

BACKGROUND OF THE INVENTION

This invention relates to trash containers. More particularly, the invention relates to a lid for use with a trash container specially adapted to help sort predetermined sized and shaped articles for disposal.

It is becoming increasingly common to recycle materials such as aluminum and in particular aluminum from containers such as beverage containers. Further, for the purpose of recycling, it may be desirable to sort such containers into their different standard sizes and to provide for a lid that can be used with standard trash containers to help sort articles being disposed into their common standard sizes and or at least to limit articles disposed to known sizes and shapes.

SUMMARY OF THE INVENTION

According to the invention, there is provided a lid adapted for removable attachment to a trash container including predetermined sized and shaped holes for limiting disposal of articles to known sizes and shapes.

An important feature of the invention provides for the lid to include two members each having a peripherial edge portion conforming generally to the configuration of portions of the rim of the trash container and a depending flange adapted to engage against an outside surface portion of the trash container at the rim.

Another feature of the invention provides for a removable attachment means in the form of a pair of facing protrusions or ears on each flange and cooperating fasteners which draw the two members together and the flanges tightly against the container.

Another feature of the invention provides for the members to have arcuate peripherial edge portions configured to fit on a cylindrical container with the arcuate peripherial edge portion having a radius slightly greater than the radius of the trash container and a length slightly less than semi-circular.

According to the invention, each member is provided with at least one hole sized and shaped to receive a predetermined size and shape of article.

According to the invention, one member includes one circular hole having a diameter for receiving a cylindrical container having a diameter not greater than the diameter of a standard twelve ounce beverage container.

According to another feature of the invention, the other member includes at least one circular hole having a diameter for receiving a cylindrical container having a diameter not greater than a standard sixteen ounce beverage container.

According to yet another feature of the invention, one member includes a second circular hole having a diameter for receiving a second cylindrical container having a diameter not greater than the diameter of a standard thirty two ounce beverage container.

A still further important feature provides for one member to include two circular holes each having a diameter for receiving a cylindrical container having a diameter not greater than a standard twelve ounce beverage container.

BRIEF DESCRIPTION OF THE DRAWINGS

The invention will be better understood after reading the following Detailed Description of the Preferred Embodiment in conjunction with the Drawing of which.

DETAILED DESCRIPTION OF THE PREFERRED EMBODIMENT

Figure 1:
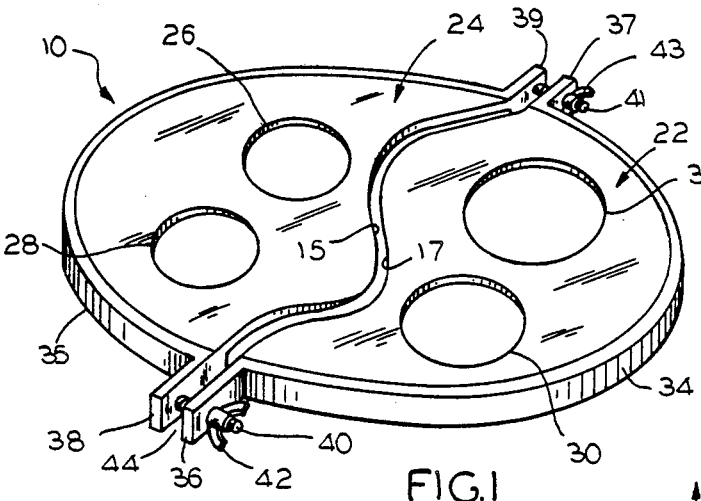
FIG. 1 is a pictorial view of a lid for a trash container according to the invention.
Figure 2:
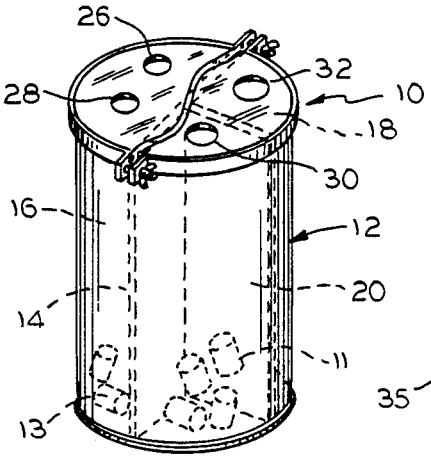
FIG. 2 is a pictorial view of the lid of FIG. 1 shown installed on a trash container.
Figure 4:
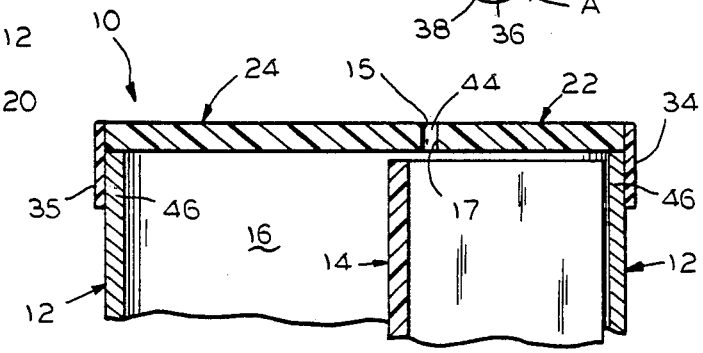
FIG. 4 is a partial cross sectional view taken along the line 4—4 in FIG. 3 showing details of construction and installation on the trash container.

Shown in FIGS. 1 and 2 is a cover 10 for use with a trash container 12 such as a standard 30 gallon garbage can or a 55 gallon drum. It is common that such standard trash containers have standard dimensions lending to the use of a lid or cover 10 such as that according to the invention on different standard containers. It is to be understood, however, that the invention is not to be considered limited to use solely with these specific containers but, rather, can be manufactured to fit any container size and shape desired. The cylindrical containers are however most common and the invention will be described with reference to such a container.

Preferrably, although not necessary to the present invention, the lid 10 is used with a trash container including an internal partition 14 either fixed or preferrably removable for subdividing the interior of the trash container into separate chambers or compartments. In the embodiment shown, the container is subdivided into three compartments 16, 18, 20 with one, for example compartment 16, making up a larger volume of the trash container interior. The compartments receive articles of different predetermined size and shape such as the different beverage cans 11, 13 shown in FIG. 2. The lid 10 when attached to the trash container over its open end provides means for separating the different predetermined shaped and sized articles. Since typically it is beverage cans that are collected for recycle, the lid is specially adapted to receive predetermined standard size cylindrical beverage cans such as the typical 12 ounce, 16 ounce and 32 ounce cans.

As shown in the drawings, the lid is a two part lid made up of two generally flat semi-circular shaped members 22, 24. Each member 22, 24 includes an arcuate peripherial edge portion carrying a depending flange 34, 35 respectively and confronting serpentine portions 15, 17. The serpentine shaped portions 15, 17 are not a limiting design and can be for example straight edges if desired however, the serpentine configuration shown helps to interlock and locate the two members on the container. Further, the length of each arcuate portion of the peripherial edges carrying the flanges 34, 35 are preferrably slightly less than a complete semi-circle providing for a clearance space 44 between the two confronting surfaces 15, 17. Further, the radius of each arcuate portion 34, 35 is at least equal to the nominal radius of the standard trash container at the rim 46 with which the lid is intended to be used and preferrably is slightly greater, for example by about ½ inch on a standard 55 gallon drum. The slightly greater radius of the arcuate portions and the less than semi-circular length of the arcuate portions advantageously allows the lid to compensate for slight differences in diameters between different waste containers or out of round of any one container by allowing the two lid members 22, 24 to be more or less separated depending on the specific container dimension at rim 46.

Figure 5:
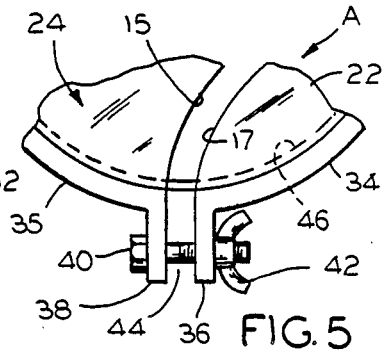
FIG. 5 is an enlarged view of the circled portion A in FIG. 3 showing details of the removable attachment means.
Figure 3:
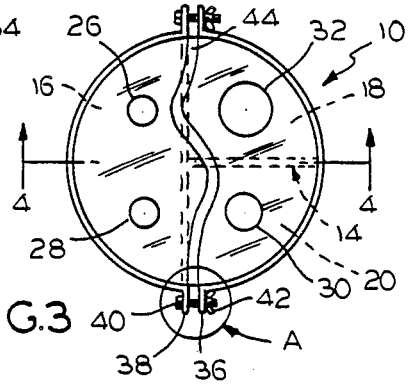
FIG. 3 is a top view of the trash container of FIG. 1 showing details of construction.

As shown in FIGS. 2, 3, 4 and 5, the depending flanges 34, 35, when drawn together by the attachment means shown in detail A in FIGS. 3 and 5, engage against corresponding opposite outside surface portions of the trash container at the rim 46. Each depending flange 34, 35 is provided with a pair of oppositely, outwardly projecting ears or protrusions 36, 37 and 38, 39 respectively. One protrusion of each pair such as 36, 38 and 37, 39, extends adjacent each other and are provided with through-holes for receiving bolts 40, 41. It can be seen, that when the lid members are disposed over the container opening and are drawn together by tightening the nuts 42, 43, the two members will be drawn together with the flanges pulled tightly against the outside surface of the container at the rim, whereby the lid is securely but removably attached to the container.

Each lid member 22, 24 is provided with at least one hole and preferrably four holes 26, 28, 30, 32 as shown in the drawings. Each hole is shaped and sized to just receive an article of predetermined shape and size so as to assist in separating different articles of known shape and size. When used to sort beverage type cans, it is preferrable that one member, such as member 24, include at least one circular hole having a diameter sized to receive a cylindrical container having a diameter not greater than a standard 12 ounce beverage container and that the other lid member 22 be provided with at least one circular hole having a diameter sized to receive a cylindrical container having a diameter not greater than the diameter of a standard 16 or 32 ounce beverage container. Preferrably, one of the members, such as member 22 shown in the drawings, includes two circular holes sized as just described to receive a 16 ounce beverage container and a 32 ounce beverage container. Also, as shown in the drawing, the one lid member 24 is provided with a second hole 28 identical to hole 26. Obviously, any number, size and combination of holes can be provided for. As noted, for the embodiment shown, one hole, such as hole 30, is adapted to receive a 16 ounce cylindrical container and is disposed over a compartment such as 20, hole 32 is adapted to receive a 32 ounce cylindrical container and is disposed over another compartment, such as 18, and holes 26, 28 are both sized to receive a 12 ounce cylidrical container and are both disposed over the larger compartment 16.

Figure 6:
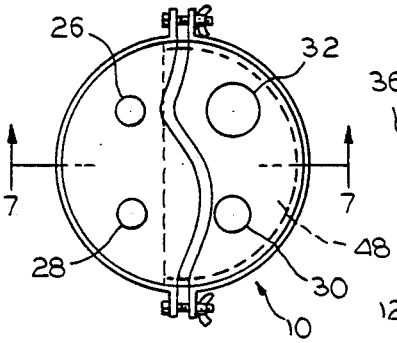
FIG. 6 is a top view of an alternative embodiment of a lid according to the invention showing details of construction.
Figure 7:
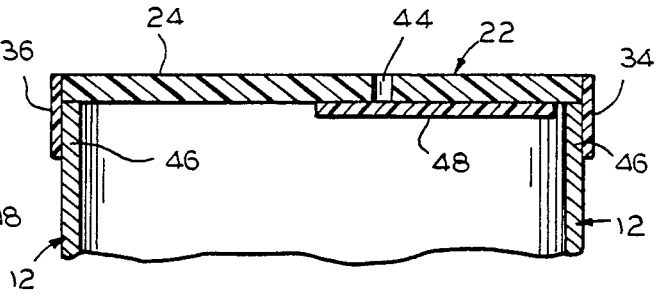
FIG. 7 is a partial cross sectional view taken along the line 7—7 in FIG. 6 showing details of construction and installation of the alternative embodiment on a trash container.

The embodiment shown in FIGS. 6 and 7 is the same as that of FIGS. 1 thru 5 except that a support member 48 is affixed to an inside surface of one of the lid members, such as member 22, which extends across the clearance gap 44 and at least partially across and in contact with the inside surface of the other lid member, such as member 24, to vertically support the two members. The vertical support member is especially effective when the lid members are made from plastic as opposed to being metallic.

Having described the preferred embodiment of the invention, those skilled in the art having the benefit of the description and accompanying drawings can readily devise other embodiments and modifications and such other embodiments and modifications are to be considered to be within the scope of the appended claims.

What is claimed is:

1. A lid for use on a trash container having a rim around an opening into said container, comprising:

a first member having a continuous peripherial edge, said first member including at least one circular hole having a diameter conforming to the diameter of a standard 12 ounce beverage can, said first member adapted to be disposed over at least a portion of the opening into said container with said at least one hole opening into said container;

a second member having a continuous peripherial edge, said second member including at least a second circular hole having a diameter conforming to the diameter of a standard 16 ounce beverage can, said second member adapted to be disposed over a remaining portion of the opening into said container with said at least second hole opening into said container; and means for removably attaching said first member and said second member to said container.

2. The lid as defined in claim 1 wherein said at least second hole is circular having a diameter conforming to the diameter of a standard 32 ounce beverage container.

3. The lid as defined in claim 1 wherein said second member includes two circular holes one having a diameter conforming to the diameter of a standard 16 ounce beverage container and the second hole having a diameter conforming to the diameter of a standard 32 ounce beverage container.

4. A lid for use with a trash container comprising:

a first member having a peripherial edge including a portion generally coinciding with a portion of a rim surrounding an opening into the container, said first member having a first depending flange along the peripherial edge portion coinciding with the rim of the container adapted to engage a first portion of an outside surface of said container with said first member disposed across a portion of said opening into said container, said first member further including at least one hole having a predetermined shape and size generally coinciding with a known article shape and size;

a second member having a peripherial edge portion including a portion generally coinciding with a remaining portion of the rim surrounding said opening into said container, said second member having a second depending flange along the peripherial edge portion coinciding with the remaining portion of the rim adapted to engage a second portion of said outside surface portion of said container generally opposite said first portion of said outside surface, said second member further including at least one additional hole having at least a predetermined size different from said at least one hole and having a shape, said size and shape generally coinciding with another known article shape and size; and means for removably connecting first and second members together and for removably holding at least opposing portions of said first and second depending flanges against the first and second portions of said outside surface of said container, whereby said lid is removably attachable to said container.

5. The lid as defined in claim 4 wherein said first and second flange portions each include a pair of diametrically opposite, outwardly protruding members, one protruding member of each pair being adjacent one protruding member of the other pair; and fastener means associated with the adjacent protruding members for fastening said adjacent protruding members together and to draw said first and second members toward each other and said first and second flanges against said first and second portions of said outside surface of said container respectively.

6. The lid as defined in claim 5 wherein said adjacent protruding members include aligned holes and said fastener means includes a bolt through said aligned holes and a nut on said bolt.

7. The lid as defined in claim 4 wherein said first member includes a circular hole having a diameter for receiving a cylindrical container having a diameter not greater than a standard 12 ounce beverage container and said second member includes two circular holes one having a diameter for receiving a cylindrical container having a diameter not greater than a standard 16 ounce beverage container and the second having a diameter for receiving a cylindrical container having a diameter not greater than a standard 32 ounce beverage container.

8. The lid as defined in claim 7, wherein said first member includes a second circular hole having a diameter for receiving a cylindrical container having a diameter not exceeding the diameter of a standard 12 ounce beverage container.

9. A lid for a trash container comprising:

a generally flat first member having a continuous peripherial edge including an arcuate portion defined by a radius not less than a known radius of said container, said first member including a depending flange along the arcuate portion of the peripherial edge, said depending flange including a first pair of oppositely protruding protrusions, one at each end of the arcuate portion, said first member further including at least one hole of predetermined size and shape;

a generally flat second member having a continuous peripherial edge including an arcuate portion defined by a radius not less than the known radius of said container and equal to the radius of said arcuate portion of said first member, said second member including a second depending flange along the arcuate portion of the peripherial edge, said second depending flange including a second pair of oppositely protruding protrusions one at each end of the arcuate portion, each of the second pair of protrusions adjacent a respective one of the first pair of protrusions, said second member further including at least one additional hole having at least a predetermined size different from the at least one hole in said first member; and fastening means associated with the adjacent protrusions for pulling said first and second members together with the first and second depending flanges against opposing outside surface portions of the container.

10. The lid as defined in claim 9 wherein the length of each of the arcuate portions of the peripherial edge of each of the first and second members is less than semicircular.

11. The lid as defined in claim 9 further including a support affixed to an inside surface of one of said first and second members extending at least partially across and in contact with an inside surface of the other of said first and second members to vertically support the other of said first and second members.

* * * * *